US005464294A

United States Patent [19]

Chee et al.

[11] Patent Number: 5,464,294

[45] Date of Patent: Nov. 7, 1995

[54] FOLDING TOOTHBRUSH

[75] Inventors: Richard W. M. Chee; Sharon A. H. Low, both of Singapore, Singapore

[73] Assignee: Fortune Dragon Pte Ltd, Singapore, Singapore

[21] Appl. No.: 294,571

[22] Filed: Aug. 23, 1994

[30] Foreign Application Priority Data

Aug. 25, 1993 [GB] United Kingdom ..... 9317697

[51] Int. Cl.[6] ..... A46B 11/02

[52] U.S. Cl. ..... 401/269; 401/155; 401/169; 401/176; 401/191

[58] Field of Search ..... 401/176, 191, 401/269, 155, 169; 15/185; 132/311

[56] References Cited

U.S. PATENT DOCUMENTS

| | | | |
|---|---|---|---|
| 2,247,003 | 6/1941 | Smith et al. | 401/191 |
| 2,445,571 | 7/1948 | Fuston | 401/191 X |
| 2,850,753 | 9/1958 | Pelletier | 132/311 X |
| 4,116,570 | 9/1978 | Parenti | 401/155 |
| 4,139,312 | 2/1979 | Marano et al. | 401/176 |
| 4,467,822 | 8/1984 | Blackwell | 132/84 B |
| 4,521,128 | 6/1985 | O'Neal | 401/269 |
| 4,760,642 | 8/1988 | Kwak | 30/123 |
| 5,088,850 | 2/1992 | Taichman et al. | 401/176 |

FOREIGN PATENT DOCUMENTS

| | | | |
|---|---|---|---|
| 1027312 | 3/1978 | Canada | 401/269 |
| 1336755 | 11/1973 | United Kingdom . | |
| 2222755 | 3/1990 | United Kingdom . | |
| WO92/07487 | 5/1992 | WIPO . | |

*Primary Examiner*—Steven A. Bratlie
*Attorney, Agent, or Firm*—Dechert Price & Rhoads

[57] ABSTRACT

A foldable toothbrush is formed from front (2) and rear (4) parts that are hingeably connected. The front part, containing the brush portion (6), has a cavity (8) for storing toothpaste. The cavity communicates with the brush portion through holes (16). The rear wall of the cavity is a slide member (22) that can slidably move forward to compress the cavity and force toothpaste through the communication holes. The rear part has a thruster 36 that is connected to a pusher (40) and is slidably confined to a track (28, 30, 44). When the foldable toothbrush is unfolded, the user can engage pusher (40) to move thruster (36) into the front part to engage the slide member (22) to push toothpaste through holes (26). The pusher (40) can then be disengaged from the front part and the toothbrush can be folded.

13 Claims, 3 Drawing Sheets

FOLDING TOOTHBRUSH

BACKGROUND OF THE INVENTION

The present invention relates to toothbrushes.

There is a demand, particularly amongst travellers, for compact and/or disposable toothbrushes. It is known to supply a simple toothbrush with a miniature tube of toothpaste to satisfy the demand for this type of product. However, the use of such miniature toothpaste tubes is extremely inconvenient. It is awkward to apply the toothpaste and the tube can easily be dropped accidentally or otherwise lost.

There are also available various types of compact toothbrushes suitable for use by travellers.

SUMMARY OF THE INVENTION

The toothbrush of the present invention is intended to solve the technical problems associated with storing and applying the toothpaste to a toothbrush.

In accordance with the present invention, a toothbrush comprises an elongate handle having front and rear parts foldably connected together; the front portion having a brush portion at one end and defining a toothpaste cavity opening into a base of the brush portion, a slide member provided for linear movement within the cavity in order to eject toothpaste into the brush portion, in use, and a manually operable pusher connected to a thruster mounted in the rear part such that it is engageable with the slide member when the toothbrush is unfolded.

By providing a toothbrush with a toothpaste cavity which can either receive a capsule of toothpaste or be readily pre-filled during production, the problems of storing and applying the toothpaste to the brush when it is required for use are eliminated.

BRIEF DESCRIPTION OF THE DRAWINGS

Two embodiments of the invention will now be described, by way of example only, with reference to the accompanying diagrammatic drawings, in which.

DESCRIPTION OF THE PARTICULAR EMBODIMENTS

Figure 3:
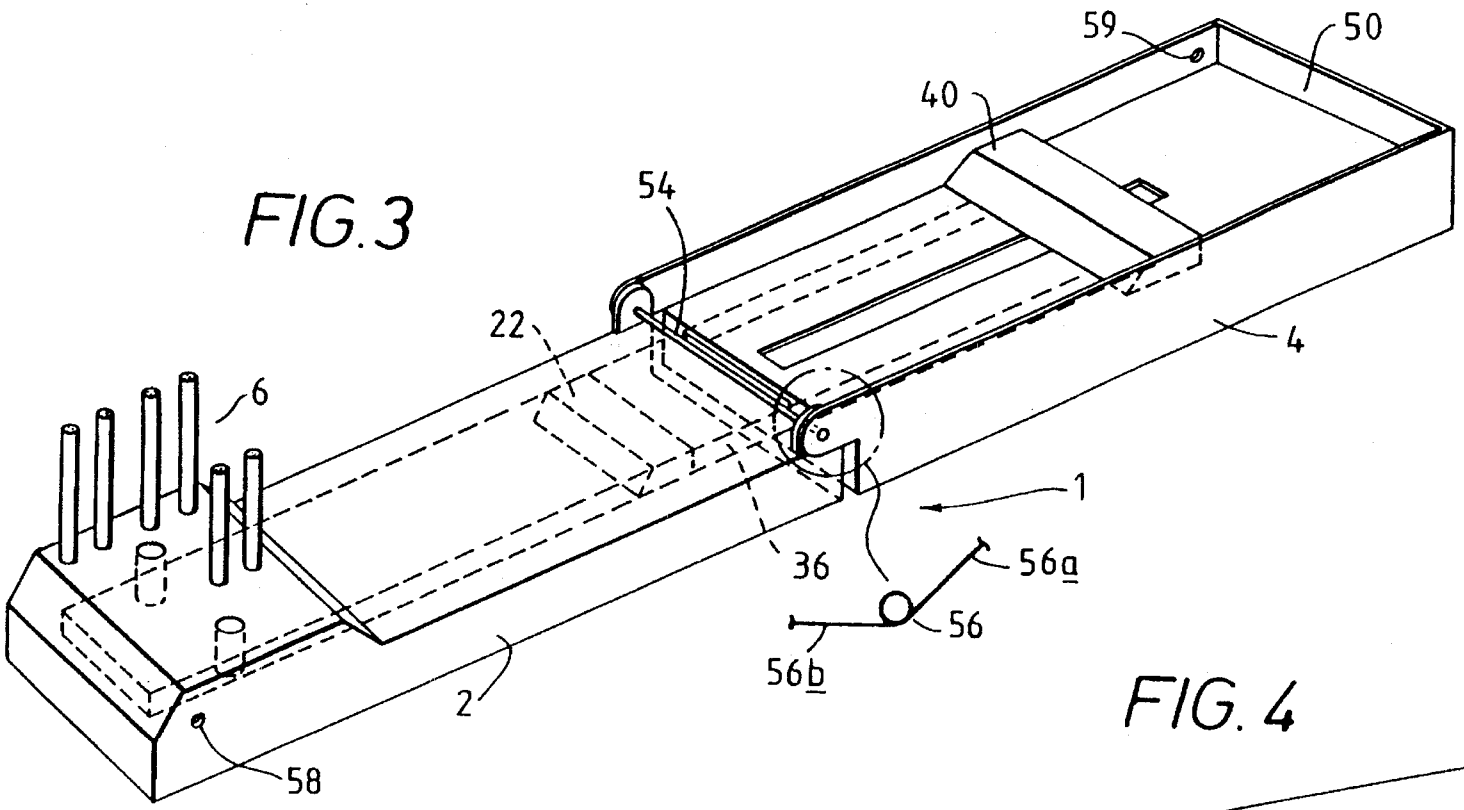
FIG. 3 is a perspective view of the toothbrush of FIG. 1 folded out ready for use.

As illustrated in FIG. 3 a first embodiment of a toothbrush 1 is formed of a front part 2 which is hingeably connected to a rear part 4. The front part carries a brush portion 6 (which is omitted for clarity in FIG. 1) and also defines a first internal cavity 8 which serves as a toothpaste compartment.

Figure 1:
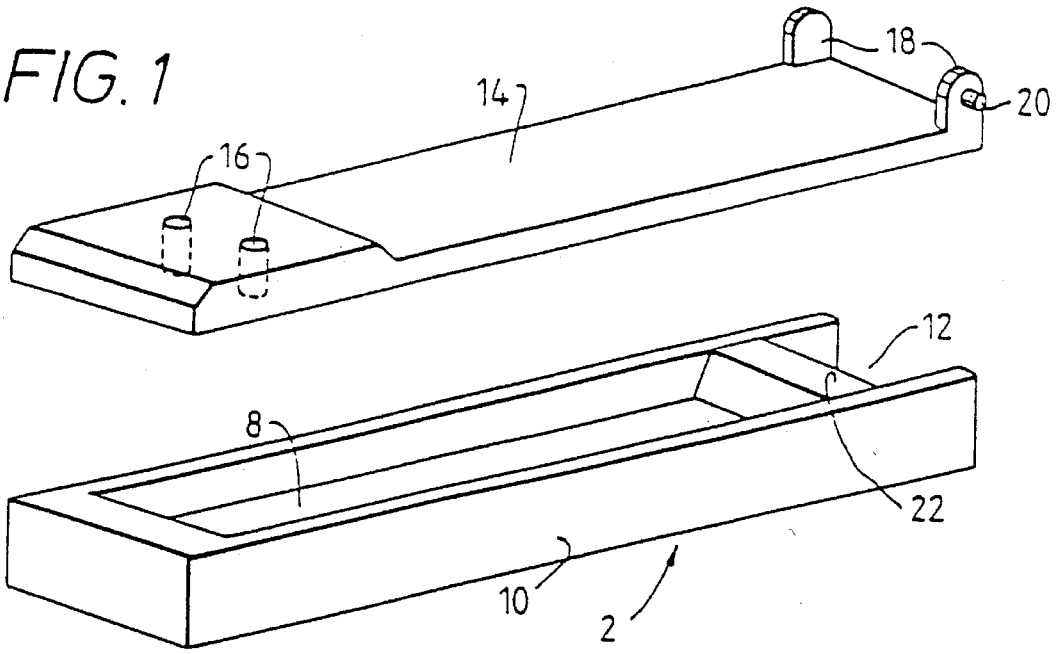
FIG. 1 is an expanded view of the front part of a first embodiment of a toothbrush.

FIG. 1 shows an expanded view to illustrate the construction of the front part 2. The front part 2 is defined by an open-topped, elongate, rectangular box member 10 which has no side wall along one narrow side 12. The interior of the box member 10 defines the cavity 8 which is either filled with toothpaste during assembly of the toothbrush or receives a pre-filled toothpaste capsule. In the remainder of the description of this embodiment it will be assumed that the cavity is charged with fluid toothpaste.

The front part 2 is provided with a cover 14 which has the same length and width dimensions as the box member 10. The brush portion 6 is situated at one end of the cover 14(see FIG. 3). Through holes 16 are provided in the cover 14 in the brush area to communicate with the toothpaste cavity below. Two holes 16 are shown but it will be appreciated that a single hole or a larger array may be used. The other end of the cover 14 is provided at each side with upwards projections 18. Each projection 18 has a laterally extending pin 20.

A slide member 22, which also serves as a stopper, is seated in the first internal cavity 8 so that it can be moved along the length of the cavity. As the slide member 22 is moved, it compresses toothpaste within the cavity 8, forcing toothpaste to move upwardly through the through holes 16 to load the brush 6.

Figure 2:
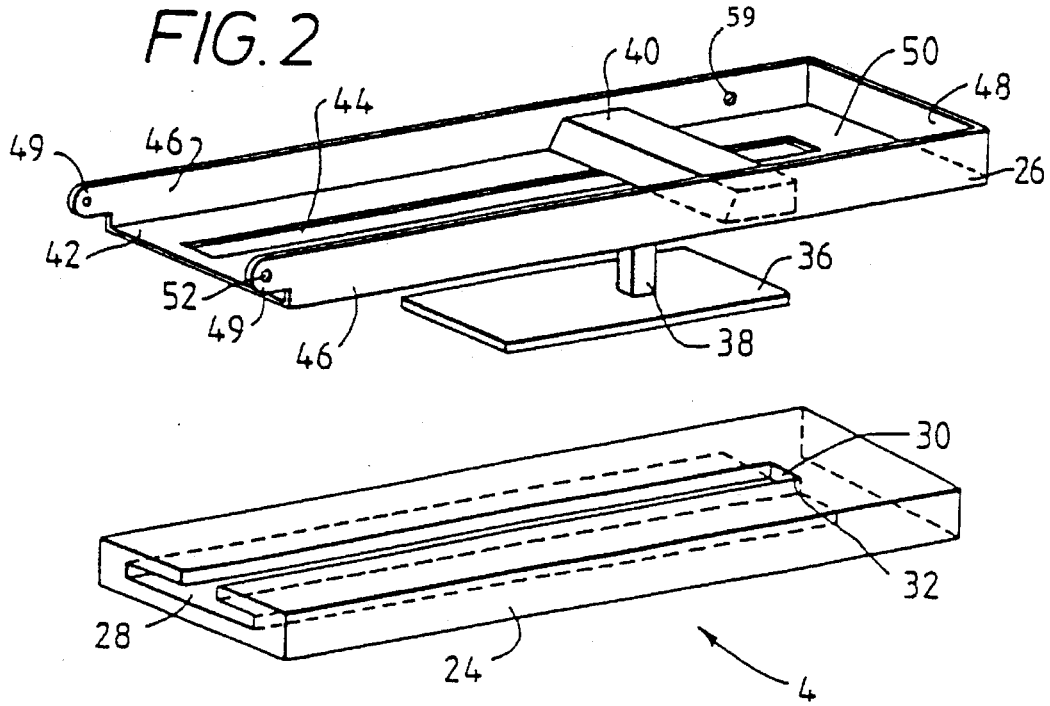
FIG. 2 is an expanded view of the rear part of the toothbrush of FIG. 1.

The rear part 4 of the toothbrush is illustrated in FIG. 2. This rear part 4 comprises a lower section 24 and an upper section 26. The lower section 24 defines a second internal cavity 28 which is closed except for an elongate key way 30 which extends from a front wall of the section 24 to a point 32 spaced from the rear of the section 24 by a distance of at least the length of the brush portion 6. The second internal cavity 28 is sized to receive a thruster 36 which has a length no greater than the length of the second internal cavity 28. The thruster 36 is connected by a connector 38, sized to fit within the key way 30, to a pusher 40.

The upper section 26 of the rear part 4 has a rectangular base member 42 in which a completely enclosed slot 44 is defined. The slot 44 lies over the key way 30 and together with the second internal cavity 28, they define a track for guiding the pusher in linear motion. The size of the base 42 corresponds to the dimensions of the upper surface of the lower section 24. The base 42 is surrounded by side walls 46 and a rear wall 48. The depth of the rear wall 48 and side walls 46 are sufficient to receive the depth of the bristles in the brush portion 6 and forms a well 50 for receiving that brush portion when the toothbrush is folded.

Each side wall 46 is provided with a projection 49 in which a hole 52 is defined. The holes 52 are sized to receive the pins 20 on the front part or the parts may be connected together by means of a spring rod 54 as shown in FIG. 3 which extends across the width of the toothbrush. During assembly, the pusher 40 is connected to the connector 38 so that the pusher and thruster combination is held trapped within the upper section 26. The thruster 38 can then be fitted within the second internal cavity 28. The slot 44 terminates short of the toothbrush well 50 to prevent the pusher moving into the area adapted to receive the brush portion 6.

The cross sectional dimensions of the main part of the second internal cavity 28 in the rear part 4 and the first internal cavity 8 in the front part 2 are preferably the same. When the thruster 36 is moved out of the rear part by the user manually sliding the pusher 40 forwards, it engages with the rear of the slide member 22 in the front part and moves that slide member 22 in its first internal cavity 8 thus ejecting toothpaste.

In order to enable the toothbrush to be held in the folded configuration during transit, a spring 56, as shown in FIG. 3 exploded out from the main drawing, is fitted around spring rod 54. The spring 56 is an elongate coil spring with projecting straight ends. The length of the coil is adapted to correspond substantially to the width of the toothbrush so that the ends 56*a*, 56*b* be along opposite sides of the front and rear part respectively. The end 56*a* lies adjacent to one of the wide walls 46 of the upper section 26. A catchment hole 59 is formed in the side wall and is adapted to engage with a bent-over terminal part of the end 56*a*. A similar catchment hole 58 is formed in one of the longer side walls of the box member 10. This catchment hole is adapted to receive a bent-over terminal part of the end 56*b* of the spring. When the spring is ends 56*a*, 56*b* are engaged with both catchment holes 58,59 in this way, the toothbrush is held shut. In order to allow the toothbrush to be opened one end of the spring must be moved out of engagement with its catchment hole by pushing a rod through the catchment hole from the exterior. This will cause the toothbrush to spring open.

The spring 56 illustrated is just one example of an embodiment of spring means which may be used to either hold the toothbrush in the open or folded configuration.

Figure 4:
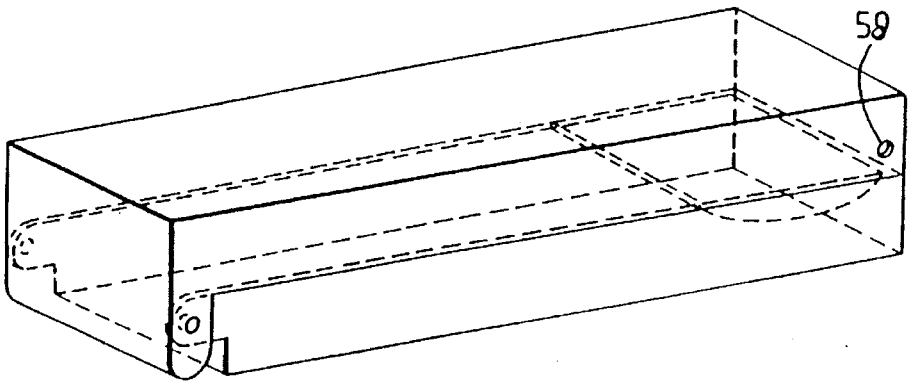
FIG. 4 is a perspective view of the toothbrush in a closed position.

The front and rear parts are assembled by means of engagement of the pins 20 or the spring rod 54 with spring 56 assembled with it in the pin holes 52 as illustrated in FIG. 3. The parts may then be folded so that the front part overlies the rear part and the brush portion 6 is received in the well 50 as illustrated in FIG. 4. In this configuration the brush portion and the through holes 16 are concealed within the well 50.

All of the components necessary for the production of such a toothbrush can readily be moulded from a plastic material. The brush portion is formed by synthetic brushes or bristles implanted into the area of the cover 14 surrounding the through holes 16 in a conventional manner. These brushes must be implanted so as to avoid obstructing the through holes 16. The cavity 8 will be pre-loaded with a suitable charge of toothpaste during assembly of the front part. When the user wishes to use the foldable toothbrush, the user simply unfolds it and applies a force to the pusher which causes the thruster 38 to move from the rear part into the front part and engage the slide member 22. This action results in the slide member sliding along the toothpaste compartment forcing toothpaste out through the holes 16.

Figure 5:
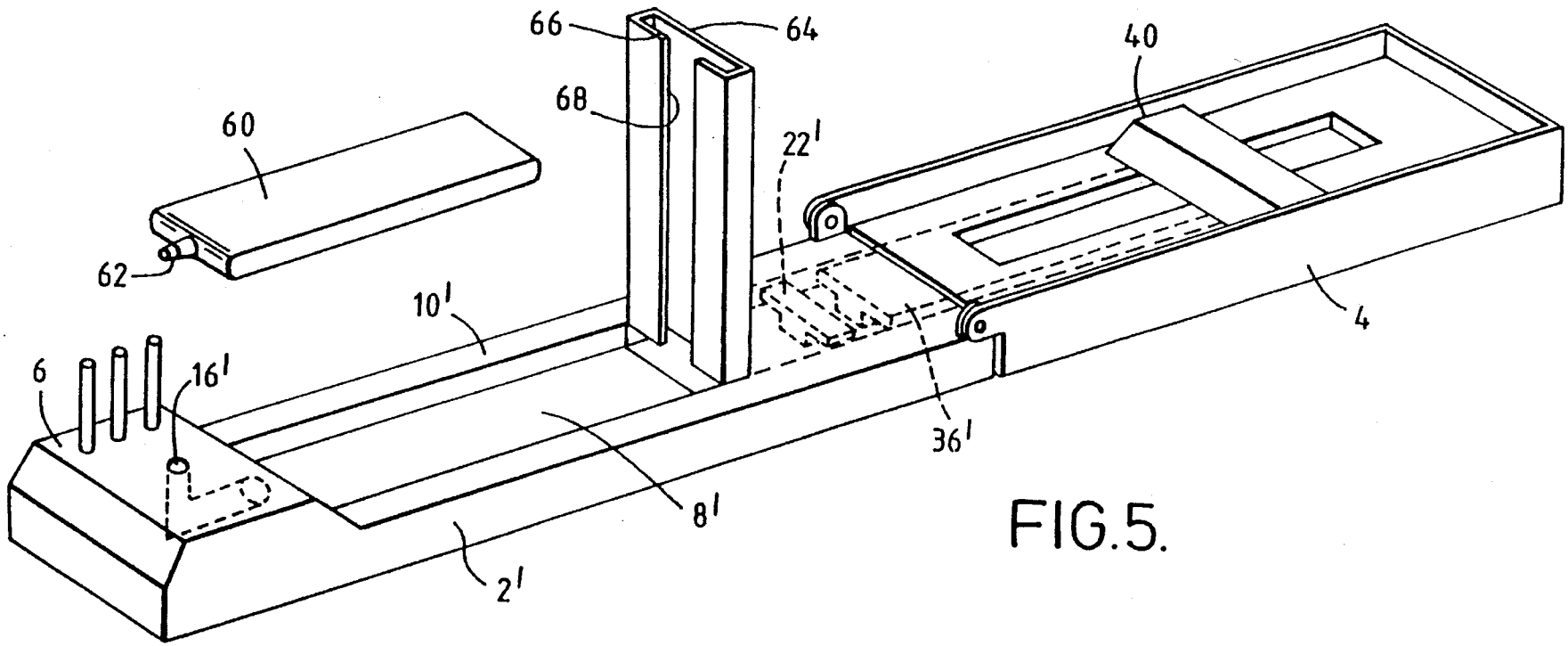
FIG. 5 is a perspective view of a second embodiment of a toothbrush.

A second embodiment of a toothbrush is shown in FIG. 5. The design of this toothbrush is essentially similar to the design of the toothbrush described with reference to FIGS. 1 to 4 and like parts are given like reference numerals. Modified parts are given the same reference numerals with the addition of a prime (').

In this second embodiment, the toothpaste compartment 8' is adapted to receive a capsule 60 filled with toothpaste. The capsule 60 is made of a flexible material so that when it is acted upon by the slide member 22' the toothpaste contained within the capsule is ejected through a nozzle 62 which engages with an opening into through hole 16. The nozzle 62 may be provided with a seal which is ruptured when pressure is applied to the capsule by the slide member.

In this embodiment, the front part 2' of the toothbrush has a brush portion integrally formed with the box member 10'. A capsule cover 64 is pivotedly mounted at one end to the side walls of the box member 10'. The capsule cover defines a third internal cavity 66 which provides a guideway for the slide member 22'. The third internal cavity 66 opens into the toothpaste first internal cavity 8' by means of a slot 68 extending along the entire length of the cover. In this embodiment, the slide member 22' and the thruster 36' are T-shaped in cross section. The cross bar of the T-shaped slide member 22' is sized to be engaged in the third internal cavity 66 which guides it as it is pushed up the toothpaste first internal cavity 8'. The depending portion of the T-shaped slide member 22' acts on the rear of the capsule 60 in order to compress it in order to eject the toothpaste contained therein.

The use of an openable capsule cover 64 allows a used toothpaste capsule to be removed and a new one inserted. This allows the toothbrush to be re-used. However, for single use applications, an openable capsule cover is not essential and the construction of the front part 2 of the toothbrush may be as described in connection with the first embodiment. The first embodiment can also be used with a toothpaste capsule inserted into the toothpaste first internal cavity 8 with suitable adaptation of the path of the through hole 16 in order to allow the nozzle 62 of the capsule to engage at the opening of the through hole 16.

Figure 6:
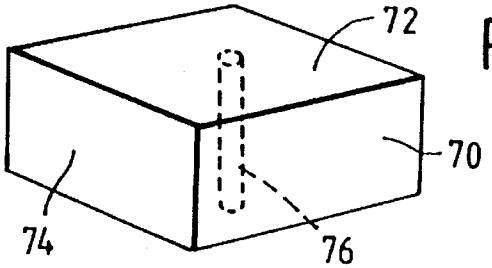
FIG. 6 shows a cap suitable for use in protecting the bristles of a brush portion of either embodiment of the toothbrush after they have been sterilised.

FIG. 6 illustrates a cap for protecting the bristles of the brush portion 6 after they have been sterilised. The cap consists of a protective cover 70 that has a rectangular top 72 with depending side walls 74 on each side. The dimensions of the cover 70 are such as to just enclose the bristles of the brush portion 6. A plastic rod 76 is mounted in a flexible rubber mounting to the interior of the top 72. The free end of the plastic rod 76 is sized to seat within the opening of the through hole 16 in the base of the brush portion so as to seal off that hole to prevent overflow of toothpaste from the cavity and to prevent oxidisation of the toothpaste. Although only a single rod has been shown, if several through holes have been provided, a matching number of rods will be needed to seal them off. The cover 70 is placed over the bristles of the brush after they have been sterilised during the manufacturing process and is removed by the consumer before use of the toothbrush.

Various alternative configurations for the toothbrush will be apparent to those skilled in the art. The folding configuration has the advantages of easy storage and better hygiene standards as all openings giving access to the toothpaste compartment 8 are enclosed.

We claim:

1. A foldable toothbrush comprising:

a front part having top, bottom, side and front surfaces and brushes located at a brush portion on the top surface adjacent to the front end of the front part, said surfaces forming an interior cavity for storing toothpaste, said upper surface having at least one opening at said brush portion connecting the cavity and the brushes;

a slide member rearwardly and forwardly slidably engaged in the toothpaste cavity;

a rear part hingeably attached at its front end to the rear end of the front part;

means attached to the rear part for slidably engaging, when the toothbrush is unfolded, the slide member to push it forward in the toothpaste cavity.

2. The foldable toothbrush as claimed in claim 1, wherein the toothpaste cavity is adapted to receive a flexible toothpaste capsule which is acted on by the slide member.

3. The foldable toothbrush as claimed in claim 2, wherein the toothpaste cavity is provided with an openable cover.

4. The foldable toothbrush as claimed in claim 3, wherein the toothpaste cavity cover defines a cavity, which guides the movement of the slide member.

5. The foldable toothbrush as claimed in claim 1, wherein the toothpaste cavity opens into the base of the brush portion by means of at least one through hole defined in said base.

6. The foldable toothbrush as claimed in claim 5, further comprising a cover to protect the brush portion which is adapted to be held to the brush portion by means of engagement of a depending rod with at least one of the through holes located at said base of the brush portion.

7. The foldable toothbrush as claimed in claim 1, further comprising spring means adapted to hold the toothbrush in either a open or closed configuration.

8. The foldable toothbrush as claimed in claim 7, wherein the spring means comprises a spring having ends adapted to be received in catchment holes formed respectively in the front and rear parts of the toothbrush.

9. The foldable toothbrush as claimed in claim 8, wherein at least one catchment hole extends to the exterior of the toothbrush in order to allow a pusher to release the spring from engagement therein to cause the toothbrush to spring open.

10. The foldable toothbrush of claim 1 further comprising a toothpaste capsule adapted to be received in the toothpaste cavity of the toothbrush.

11. The foldable toothbrush as claimed in claim 1, wherein the rear part comprises a well for receiving the brushes when the toothbrush is folded.

12. The foldable toothbrush as claimed in claim 1, wherein the engaging means comprises a thruster rearwardly and forwardly slidably engaged with the rear portion and attached to a pusher adapted to be engaged by a user to move the thruster forwards or backwards.

13. The foldable toothbrush as claimed in claim 12, wherein the thruster is of substantially the same transverse cross-section as the slide member.

* * * * *